US012426770B2

(12) United States Patent
Tian et al.

(10) Patent No.: US 12,426,770 B2
(45) Date of Patent: Sep. 30, 2025

(54) SHOE WASHING MACHINE

(71) Applicants: QINGDAO HAIER WASHING MACHINE CO., LTD., Shandong (CN); Haier Smart Home Co., Ltd., Shandong (CN)

(72) Inventors: Yun Tian, Qingdao (CN); Youxi Wang, Qingdao (CN); Qi Wang, Qingdao (CN); Weihui Chen, Qingdao (CN); Lei Yan, Qingdao (CN); Chao Qiu, Qingdao (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 345 days.

(21) Appl. No.: 18/245,759

(22) PCT Filed: Feb. 1, 2021

(86) PCT No.: PCT/CN2021/074674
§ 371 (c)(1),
(2) Date: Mar. 17, 2023

(87) PCT Pub. No.: WO2021/232851
PCT Pub. Date: Nov. 25, 2021

(65) Prior Publication Data

US 2023/0380657 A1 Nov. 30, 2023

(30) Foreign Application Priority Data

Sep. 25, 2020 (CN) ..... 202022147575.X
Dec. 23, 2020 (CN) ..... 202011545053.3

(51) Int. Cl.
*A47L 23/02* (2006.01)
*A46B 5/00* (2006.01)
(Continued)

(52) U.S. Cl.
CPC ..... *A47L 23/02* (2013.01); *A46B 5/0095* (2013.01); *A46B 9/026* (2013.01); *A46B 13/02* (2013.01); *A46B 2200/306* (2013.01)

(58) Field of Classification Search
CPC ..... A47L 23/02; A46B 5/0095; A46B 9/026
See application file for complete search history.

(56) References Cited

FOREIGN PATENT DOCUMENTS

CN 201840452 U 5/2011
CN 105796036 A 7/2016
(Continued)

OTHER PUBLICATIONS

International Search Report (English translation included) dated Jun. 25, 2021, in corresponding International Application No. PCT/CN2021/074674, 8 pages.

*Primary Examiner* — Shay Karls
(74) *Attorney, Agent, or Firm* — Maier & Maier, PLLC

(57) ABSTRACT

A shoe washing machine, including a housing, a washing tub provided in the housing, a pulsator, and a driving part. The shoe washing machine also includes a brush provided on the top center of the pulsator, and the brush is configured to be in a shape that projects upward from the top of the pulsator. When the pulsator rotates, the pulsator can drive the brush to rotate at the same time, so that bristles of the brush can move relative to shoes to rub and brush the shoes, so that by improving the linear smoothness of the brushing surface of the brush, an effect of brushing without damaging the shoes can be achieved, and the probability of the shoes getting stuck by the brush can be reduced.

10 Claims, 7 Drawing Sheets

(51) Int. Cl.
*A46B 9/02* (2006.01)
*A46B 13/02* (2006.01)

(56) References Cited

FOREIGN PATENT DOCUMENTS

| | | | |
|---|---|---|---|
| CN | 105796038 | A | 7/2016 |
| CN | 107898425 | A | 4/2018 |
| CN | 110318202 | A | 10/2019 |
| CN | 209966311 | U | 1/2020 |
| CN | 210596673 | U | 5/2020 |
| CN | 211213033 | U | 8/2020 |
| CN | 211227730 | U | 8/2020 |
| CN | 211324843 | U | 8/2020 |
| JP | S63262195 | A | 10/1988 |
| KR | 20030084308 | A | 11/2003 |

SHOE WASHING MACHINE

FIELD

The present disclosure belongs to the technical field of washing apparatus, and specifically provides a shoe washing machine.

BACKGROUND

A shoe washing machine is a household appliance that can wash shoes according to cleaning requirements of the shoes. Generally, a shoe washing chamber of the shoe washing machine is internally provided with a brush, a spray device or a combination of the brush and the spray device for the purpose of shoe cleaning. Since a direct rub-brushing method of the brush has a strong cleaning ability, the brush that can brush surfaces of the shoes will be rotatably arranged in most of the shoe washing machines. There is a kind of shoe washing machine with a built-in rotating brush on the market, and the shoe washing chamber thereof is in the form of a washing tub. An inner bottom portion of the washing tub of this kind of shoe washing machine is provided with a rotatable pulsator, and a top portion of the pulsator is provided with a columnar brush roller. Bristles are arranged along the surface of the column of the brush roller, so that the pulsator drives the brush to rotate to wash the shoes.

The disadvantage of this kind of shoe washing machine is that a main brushing surface formed by terminal ends of the bristles is a columnar side face of the brush roller; when the shoes are stirred by the pulsator, the shoes can be brushed only when they reach a center of the pulsator. However, when there are a large number of shoes to be washed, multiple shoes will be stacked and collected together to form irregular gaps around the brush roller, which will cause most of the bristles to be suspended in the gaps and make most of the bristles of the brushing surface fail to play a cleaning role, thus leading to a poor brushing effect. In addition, a top portion of the columnar brush roller is rigid and protruding, so that the surfaces of the shoes are very easily worn by the top portion of the brush roller when the shoes are stirred by the pulsator.

Accordingly, there is a need for a new shoe washing machine in the art to solve the above problems.

SUMMARY

In order to solve the above problems in the prior art, that is, to solve the problems that the arrangement of the brush of the existing pulsator shoe washing machine has a poor brushing effect and the shoes are easily worn by the top portion, the present disclosure provides a shoe washing machine, which includes a washing tub, a pulsator rotatably arranged at an inner bottom portion of the washing tub, and a brush arranged at a center of a top portion of the pulsator, and the brush is arranged in a shape that bulges upward from the top portion of the pulsator.

In a preferred technical solution of the shoe washing machine described above, the brush is arranged to have a radial size that gradually increases or stepwise increases from a top portion to a bottom portion.

In a preferred technical solution of the shoe washing machine described above, the brush is a bowl-shaped brush, a conical brush, a spherical brush or a dome-shaped brush.

In a preferred technical solution of the shoe washing machine described above, the brush includes a lower section and an upper section; the lower section is arranged in a columnar shape, and the upper section is arranged in a shape that bulges upward from a top portion of the lower section.

In a preferred technical solution of the shoe washing machine described above, the upper section is bowl-shaped, conical, spherical or dome-shaped.

In a preferred technical solution of the shoe washing machine described above, a bottom portion of the brush is arranged to abut against the top portion of the pulsator.

In a preferred technical solution of the shoe washing machine described above, the brush is detachably connected with the pulsator.

In a preferred technical solution of the shoe washing machine described above, a bottom portion of the brush is provided with a sleeve-like snap-fit seat, a side wall of the sleeve-like snap-fit seat is provided with a plurality of snap-fit grooves in a circumferential direction, and the top portion of the pulsator is provided with snap-fit protrusions matching with the snap-fit grooves.

In a preferred technical solution of the shoe washing machine described above, the snap-fit protrusions are water-stirring ribs of the pulsator, and a snap-fit column matching with the sleeve-like snap-fit seat by insertion is provided at a center intersection position of the water-stirring ribs.

In a preferred technical solution of the shoe washing machine described above, the sleeve-like snap-fit seat is gradually expanded outward from top to bottom.

In a preferred technical solution of the shoe washing machine described above, a bottom portion of the brush is provided with a sleeve-like snap-fit seat, and an inside top portion of the sleeve-like snap-fit seat is provided with a plurality of pins in a circumferential direction; the top portion of the pulsator is provided with a snap-fit column matching with the sleeve-like snap-fit seat by insertion, and the snap-fit column is provided with holes matching with the pins.

In a preferred technical solution of the shoe washing machine described above, the bottom portion of the brush is provided with a threaded structure, and the pulsator is further provided with a fastener through hole aligned with the threaded structure.

In a preferred technical solution of the shoe washing machine described above, the brush is integrally arranged with the pulsator.

Solution 1: a shoe washing machine, wherein the shoe washing machine includes a washing tub, a pulsator rotatably arranged at an inner bottom portion of the washing tub, and a brush arranged at a center of a top portion of the pulsator, and the brush is arranged in a shape that bulges upward from the top portion of the pulsator.

Solution 2: the shoe washing machine according to Solution 1, wherein the brush is arranged to have a radial size that gradually increases or stepwise increases from a top portion to a bottom portion.

Solution 3: the shoe washing machine according to Solution 2, wherein the brush is a bowl-shaped brush, a conical brush, a spherical brush or a dome-shaped brush.

Solution 4: the shoe washing machine according to Solution 1, wherein the brush includes a lower section and an upper section; the lower section is arranged in a columnar shape, and the upper section is arranged in a shape that bulges upward from a top portion of the lower section.

Solution 5: the shoe washing machine according to Solution 4, wherein the upper section is bowl-shaped, conical, spherical or dome-shaped.

Solution 6: the shoe washing machine according to Solution 1, wherein a bottom portion of the brush is arranged to abut against the top portion of the pulsator.

Solution 7: the shoe washing machine according to Solution 1, wherein the brush is detachably connected with the pulsator.

Solution 8: the shoe washing machine according to Solution 7, wherein a bottom portion of the brush is provided with a sleeve-like snap-fit seat, a side wall of the sleeve-like snap-fit seat is provided with a plurality of snap-fit grooves in a circumferential direction, and the top portion of the pulsator is provided with snap-fit protrusions matching with the snap-fit grooves.

Solution 9: the shoe washing machine according to Solution 8, wherein the snap-fit protrusions are water-stirring ribs of the pulsator, and a snap-fit column matching with the sleeve-like snap-fit seat by insertion is provided at a center intersection position of the water-stirring ribs.

Solution 10: the shoe washing machine according to Solution 9, wherein the sleeve-like snap-fit seat is gradually expanded outward from top to bottom.

Solution 11: the shoe washing machine according to Solution 7, wherein a bottom portion of the brush is provided with a sleeve-like snap-fit seat, and an inside top portion of the sleeve-like snap-fit seat is provided with a plurality of pins in a circumferential direction; the top portion of the pulsator is provided with a snap-fit column matching with the sleeve-like snap-fit seat by insertion, and the snap-fit column is provided with holes matching with the pins.

Solution 12: the shoe washing machine according to Solution 8 or 11, wherein the bottom portion of the brush is provided with a threaded structure, and the pulsator is further provided with a fastener through hole aligned with the threaded structure.

Solution 13: the shoe washing machine according to Solution 1, wherein the brush is integrally arranged with the pulsator.

It can be understood by those skilled in the art that the top portion of the pulsator of the shoe washing machine of the present disclosure is provided with a brush, which is in the form that bulges upward from the top portion of the pulsator. As compared with the conventional columnar brush, through the arrangement of the above brush, first, the problem that the columnar brush can only brush through the vertical columnar surface on the side portion can be optimized. The upward bulging shape of the brush of the present disclosure has a brushing surface with an increased spatial deployment degree from top to bottom, and a side brushing range of this brushing surface is larger, which increases a brushing angle of the brush to the shoes, enables the brush to carry out spatial rub-washing on the shoes with no dead angle in the circumferential direction, greatly improves a contact frequency between the brush and the shoes during the washing process, alleviates the problem of small contact probability between the brush and the shoes when many shoes are piled up around the brush, and optimizes the shoe brushing effect. Moreover, the bulging shape of the above brush can leave more washing space for the shoes in the circumferential direction of the side portion of the brush, and a streamline direction from the side portion to the top portion of the brush becomes smoother, which can not only greatly mitigate the problem that the shoes are easily stuck between the brush and an inner wall of the washing tub in case of a large number of shoes, and reduce the probability that the shoes in the washing tub are stuck with the brush, but also can make a brushing action of the brush smoother when rubbing a certain part of the shoes, and make the brushing effect softer. The shape, color, accessories or fiber weaving direction of the surfaces of the brushed shoes are better kept, and the shoes will not be damaged while they are washed clean.

Preferably, the brush is a bowl-shaped brush, a conical brush, a spherical brush, or a dome-shaped brush that bulges upward. Brushes of these shapes each have a radial size that gradually increases from the top portion to the bottom portion, and each have a brushing surface with smooth and gradually changing streamline. When the shoe is stirred and thrown up by the pulsator, contacts with the brush and falls down, the brushing surface of this kind of brush, which is gradually expanded from the top portion to the bottom portion, has a certain cushioning effect on the shoe sliding down along the brushing surface, which prolongs the rubbing time of the shoe each time it contacts with the brush, improves the efficiency of shoe brushing, and has a soft and efficient brushing effect while greatly reducing the probability of the shoe being stuck.

Further, the bottom portion of the brush is arranged to abut against the top portion of the pulsator, so as to reduce a gap between the brush and the top portion of the pulsator, reduce the possibility that the shoes are stuck between the brush and the pulsator, and avoid that individual shoes are not brushed clean enough or stuck and damaged.

Further, the brush is detachably connected with the pulsator, so that users or maintenance personnel can detach and replace the brush when the brush is damaged, which improves the convenience of using the shoe washing machine.

Further, the bottom portion of the brush is provided with a sleeve-like snap-fit seat, a side wall of the sleeve-like snap-fit seat is provided with a plurality of snap-fit grooves in a circumferential direction, and the top portion of the pulsator is provided with snap-fit protrusions matching with the snap-fit grooves, so that there can be multiple snap-fit points between the bottom portion of the brush and the pulsator, which improves the convenience of detaching and installing the brush on the premise of ensuring the installation reliability of the brush.

Further, the snap-fit protrusions are water-stirring ribs of the pulsator. By providing the snap-fit structure for installing the brush as the water-stirring ribs, a structural layout space at the top portion of the pulsator can be prevented from being occupied and the manufacturing process complexity of the pulsator can be avoided. At the same time, a snap-fit column matching with the sleeve-like snap-fit seat by insertion is provided at a center intersection position of the water-stirring ribs, which further improves the installation reliability of the brush.

Preferably, the sleeve-like snap-fit seat is gradually expanded outward from top to bottom, which increases a snap-fit area between the bottom portion of the brush and the pulsator, improves an anti-shaking effect of the brush, and further improves the installation reliability of the brush.

DETAILED DESCRIPTION

Preferred embodiments of the present disclosure will be described below with reference to the accompanying drawings. It should be understood by those skilled in the art that these embodiments are only used to explain technical principles of the present disclosure, and are not intended to limit the scope of protection of the present disclosure.

It should be noted that in the description of the present disclosure, terms indicating directional or positional relationships, such as "center", "upper", "lower", "vertical", "horizontal", "inner", "outer" and the like, are based on the directional or positional relationships shown in the accompanying drawings. They are only used for ease of description, and do not indicate or imply that the device or element must have a specific orientation, or be constructed or operated in a specific orientation; therefore, they should not be considered as limitations to the present disclosure.

In addition, it should also be noted that in the description of the present disclosure, unless otherwise clearly specified and defined, terms "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be internal communication between two elements. For those skilled in the art, the specific meaning of the above terms in the present disclosure can be interpreted according to specific situations.

Figure 1:
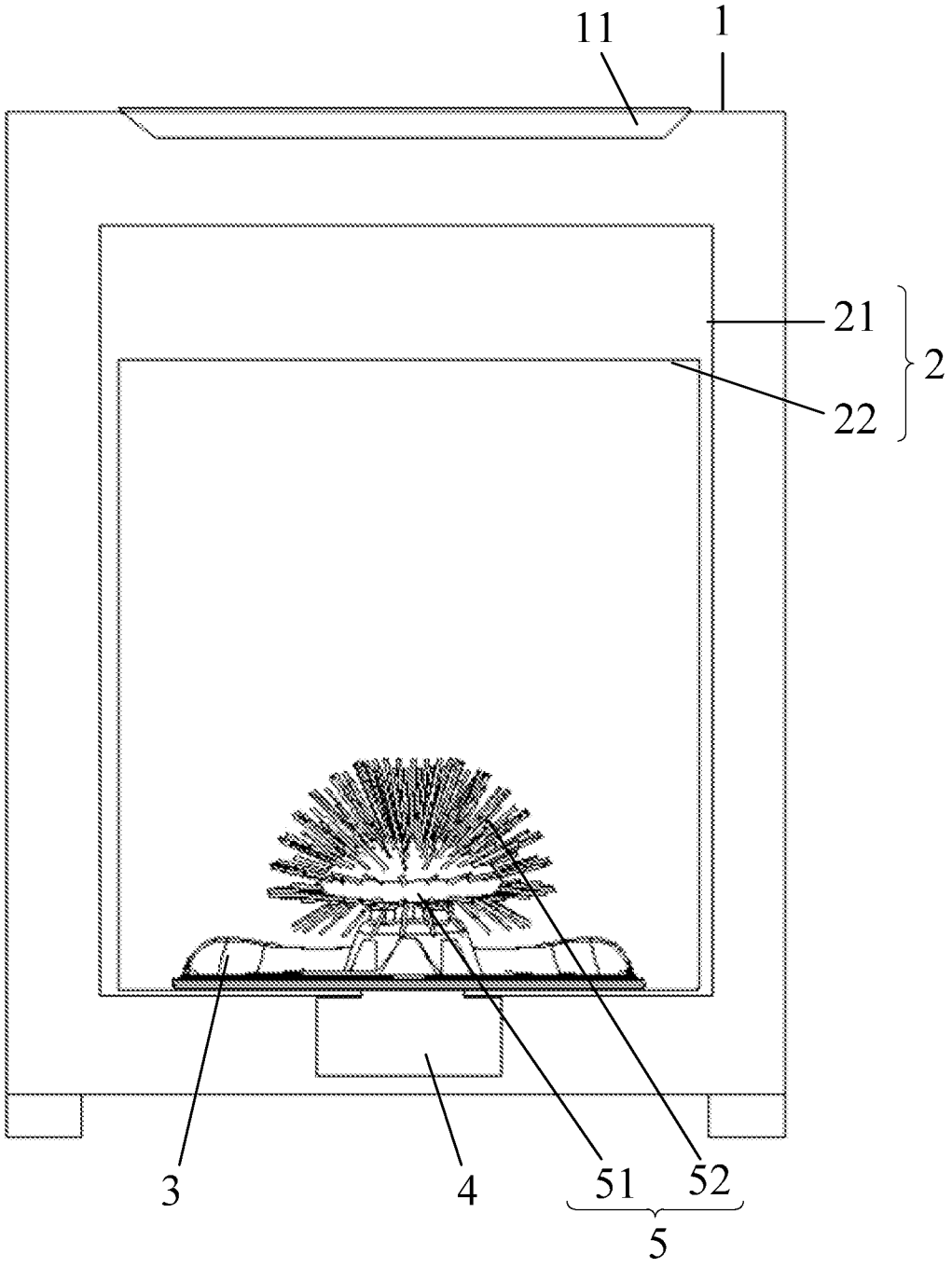
FIG. 1 is a schematic view of an overall structure of a shoe washing machine of the present disclosure.

First, reference is made to FIG. 1, which is a schematic view of an overall structure of the shoe washing machine of the present disclosure. As shown in FIG. 1, the shoe washing machine of the present disclosure includes a shell 1, as well as a washing tub 2, a pulsator 3 and a driving part 4 that are arranged inside the shell 1. The washing tub 2 is arranged vertically, and a top portion of the shell 1 is provided with a throw-in port that corresponds to an opening of the tub, and a door cover 11 that can close/open the throw-in port. The washing tub 2 can be a single-layer tub body fixedly arranged inside the shell 1, which is closed and sealed, and can directly hold washing water. The pulsator 3 is rotatably arranged at an inner bottom portion of the single-layer tub body, and the driving part 4 only drives the pulsator 3 to rotate. Alternatively, the washing tub 2 can also include an outer tub 21 fixedly arranged inside the shell 1 and an inner tub 22 rotatably arranged in the outer tub 21; a tub body of the outer tub 21 is closed and sealed, and a tub body of the inner tub 22 is provided with a water passing hole. The pulsator 3 is rotatably arranged at an inner bottom portion of the inner tub 22, and the driving part 4 drives the inner tub 22 and the pulsator 3 to rotate respectively. The above shoe washing machine further includes a brush 5 arranged at a center of a top portion of the pulsator 3. The brush 5 is arranged in a shape that bulges upward from the top portion of the pulsator 3. When the pulsator 3 rotates, it can drive the brush 5 to rotate at the same time, so that bristles of the brush 5 can move relative to the shoes and then rub and brush the shoes, thus ensuring a non-destructive brushing effect of the shoes by improving linear smoothness of a brushing surface of the brush 5 and reducing the probability of the shoes being stuck by the brush 5.

In the above embodiment, the above brush 5 includes a body 51 and bristles 52 provided on the body 51. The case where the above brush 5 is arranged in a shape that bulges upward from the top portion of the pulsator 3 specifically includes: if the bristles 52 have the same length, the body 51 will be arranged to bulge upward from the top portion of the pulsator 3, and an outer surface of the body 51 and a brushing surface formed by terminal ends of the overall bristles 52 both have a shape that bulges upward; alternatively, the shape of the body 51 is not limited, but the bristles have different lengths, so that the brushing surface formed by the terminal ends of the overall bristles 52 can form an upward bulging shape.

In addition, the above driving part 4 includes at least a driving motor connected with the pulsator 3 or the inner tub 22. Transmission devices such as a reducer and a clutch or a power reversing device can be provided between the driving motor and the pulsator 3 or the inner tub 22 according transmission requirements. For example, when the inner tub 22 and the pulsator 3 need to be driven respectively, the driving motor can be connected to the pulsator 3 or the inner tub 22 respectively through a gear set or a pulley set, the clutch, etc., so as to drive the inner tub 22 or the pulsator 3 according to requirements of the washing process; alternatively, when only the pulsator 3 needs to be driven, the driving motor can be directly connected to the pulsator 3. Since the specific arrangement of the above driving part 4 is the same as the driving mode of the conventional pulsator 3 or inner tub 22, a detailed description will be omitted herein.

A preferred technical solution of the present disclosure will be described in detail below in connection with a preferred situation in which the bristles 52 have the same length and the body 51 is arranged in a shape that bulges upward from the top portion of the pulsator 3.

Figure 2:
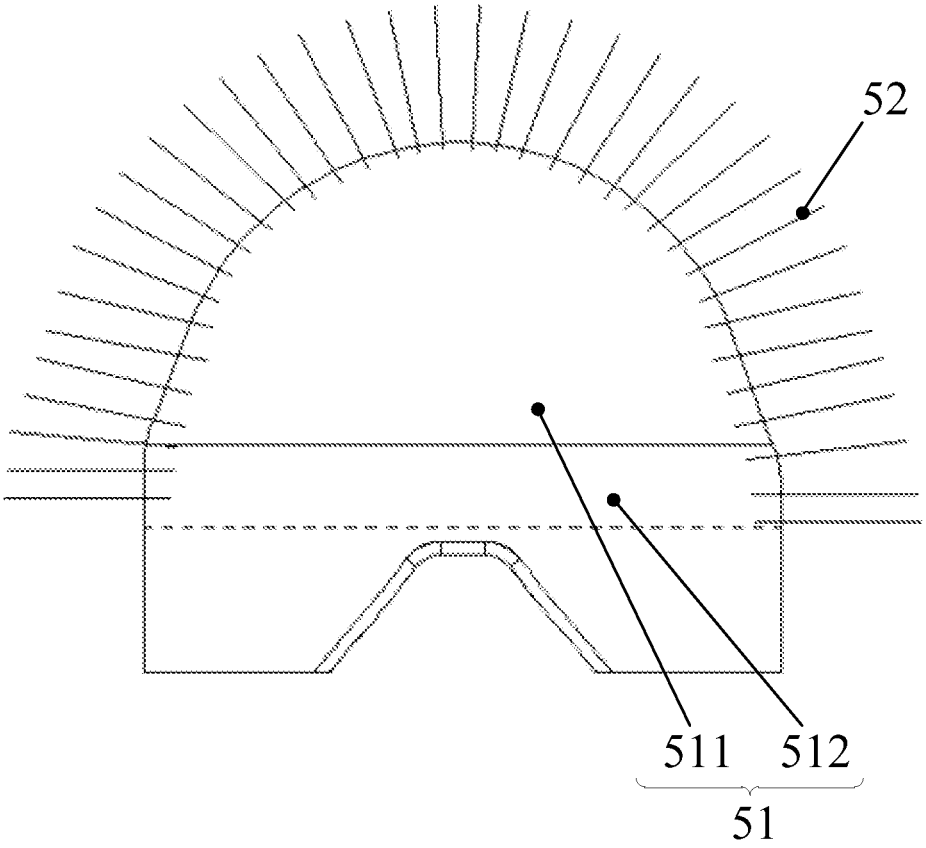
FIG. 2 is a first simplified structural view of a non-direct bulging brush of the shoe washing machine of the present disclosure.

Reference is then made to FIG. 2, which is a first simplified structural view of a non-direct bulging brush of the shoe washing machine of the present disclosure. As shown in FIG. 2, in a possible embodiment, the shape of the brush 5 which bulges upward from the top portion of the pulsator 3 is specifically that a bottom portion of the brush 5 is provided with a bulging base, and a middle portion or a middle and lower portion of the brush 5 bulges upward based on the bulging base. Specifically, the body 51 includes an upper section 511 located above and a lower section 512 connected below the upper section 511; the upper section 511 is used as a basic structure for forming the bulging shape, and its radial size is not strictly limited as changing with a radial size of the bulging structure located above. As shown in FIG. 2, the upper section 511 of the body 51 is dome-shaped, and the lower section 512 is columnar. The body 51 takes the columnar bottom portion as the bulging base, and only the upper portion is of the upward bulging shape.

It should be noted that the brush 5 with the bulging base provided at the bottom portion is not limited to the shape shown in FIG. 2. For example, the upper section 511 can also be bowl-shaped, conical or spherical other than being dome-shaped. For another example, the radial size of the brush 5 can also be increased stepwise from top to bottom. The lower section 512 of this kind of brush 5 can also include multiple (i.e., two or more) columnar structures, i.e., columnar sections stacked from bottom to top, and the radial size of each section of the columnar structures increases stepwise from top to bottom, so that the brush 5 has a trend of bulging upward as a whole.

Figure 3:
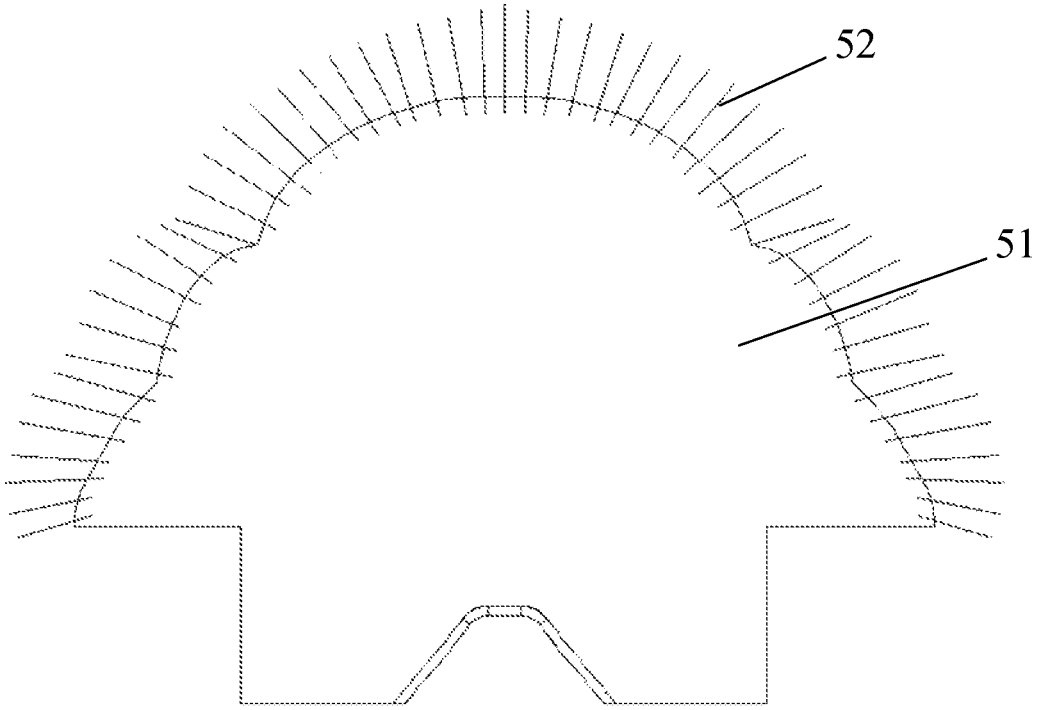
FIG. 3 is a second simplified structural view of the non-direct bulging brush of the shoe washing machine of the present disclosure.

Reference is then made to FIG. 3, which is a second simplified structural view of the non-direct bulging brush of the shoe washing machine of the present disclosure. As shown in FIG. 3, in another possible embodiment, the shape of the brush 5 which bulges upward from the top portion of the pulsator 3 is specifically that the brush 5 bulges directly from the top portion of the pulsator 3. In this case, the body 51 bulges upward directly with the bottom portion as a start point, and the radial size of the body 51 increases stepwise from top to bottom. The body 51 of the brush 5 shown in FIG. 3 includes three brush segments, and a radial size of each brush segment gradually increases from top to bottom. However, the radial size at connection positions of the three brush segments does not change uniformly, and there is a position of sudden change in the radial size at the connection positions of the brush segments. However, the three brush segments have a trend of bulging upward from top to bottom as a whole. Of course, in addition to the brush segments with arc on the side as shown in FIG. 3, at least one of the multiple brush segments included in the brush 5 can also be a columnar brush segment with a fixed radial size if the radial size of the brush 5 gradually increases from top to bottom. In this case, the brush 5 includes multiple columnar brush segments, and the radial size of the columnar brush segments increases in turn from top to bottom.

Figure 4:
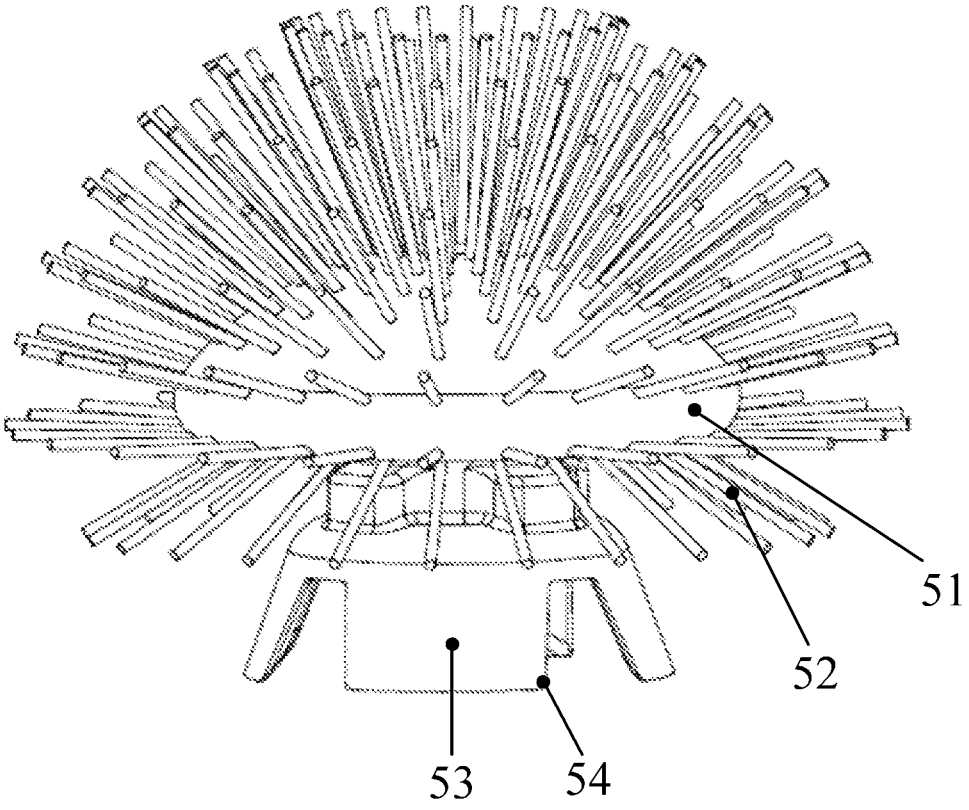
FIG. 4 is a front structural view of a dome-shaped brush of the shoe washing machine of the present disclosure.
Figure 5:
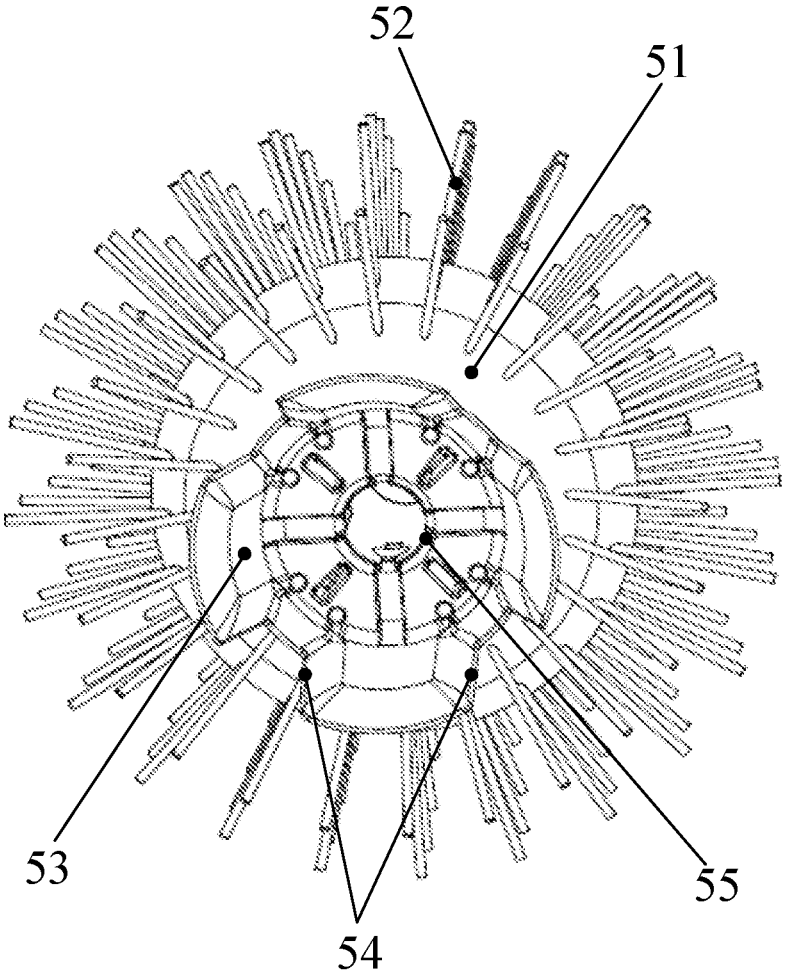
FIG. 5 is a bottom structural view of the dome-shaped brush of the shoe washing machine of the present disclosure.

Reference is then made to FIGS. 4 and 5 and continued reference is made to FIG. 1, in which FIG. 4 is a front structural view of a dome-shaped brush of the shoe washing machine of the present disclosure, and FIG. 5 is a bottom structural view of the dome-shaped brush of the shoe washing machine of the present disclosure. As shown in FIGS. 1, 4 and 5, in a preferred embodiment, the shape of the brush 5 which bulges upward from the top portion of the pulsator 3 is specifically that the brush 5 bulges directly from the top portion of the pulsator 3. In this case, the body 51 bulges upward directly with the bottom portion as a start point, the radial size of the body 51 gradually increases from top to bottom, and the body 51 extends in a gradually expanding manner from top to bottom as a whole. As an example, the above brush 5 may be a bowl-shaped brush with a flat top and an outward bulging arc-shaped surface surrounding the side, or it may be a conical brush with a pointed top and a straight side, or a truncated conical brush with a flat top and a straight side, or a dome-shaped brush which bulges upward. Shown in FIG. 4 is an upward bulging dome-shaped brush. According to the orientation of FIG. 4, the body 51 of the dome-shaped brush is a rotating body obtained by rotating an upward protruding arc segment and a straight line segment around a vertical rotation axis, in which the straight line segment extends from a bottom end of the arc segment in a direction approaching the vertical rotation axis. A curved surface part of the rotating body and a junction position between the curved surface part and a bottom horizontal surface are fully covered with the bristles 52 to form a dome-shaped brush, and terminal ends of the bristles 52 form a dome-shaped brushing surface as a whole. The curvature of the curved surface of the dome-shaped brush and the radial size of the bottom horizontal surface can be set according to the washing requirements.

It can be understood by those skilled in the art that although the brush of the above embodiment is described in connection with a preferred situation in which the radial size gradually increases from the top portion to the bottom portion, the shape of the brush 5 is not strictly limited to this situation. For example, the brush 5 of the present disclosure can also be arranged such that in the direction from the top portion to the bottom portion, the radial size of one part gradually increases, and the radial size of another part gradually decreases from the maximum radial size position, as long as most parts of the body 51 of the brush 5 each has a radial size that gradually increases from the top portion to the bottom portion, and a height of the part with decreasing radial size is almost negligible. For example, the shape of the body 51 can also be a three-quarters sphere, etc., as long as the set height of the part with decreasing radial size on the body 51 does not have a negative influence on the soft and efficient brushing effect of the brush 5 and the effect of reducing a frequency of the shoes being stuck.

Preferably, the bottom portion of the brush 5 of the present disclosure is arranged to abut against the center of the top portion of the pulsator 3, so as to avoid an obvious gap between the brush 5 and the pulsator 3, which would otherwise further cause the shoes to be stuck between the brush 5 and the pulsator 3.

With continued reference to FIGS. 1, 4 and 5, in a specific embodiment, the horizontal surface of the bottom portion of the dome-shaped brush is arranged to abut against the highest position of the center of the top portion of the pulsator 3, so as to avoid the formation of a gap with a large radial depth and a large vertical height between the bottom portion of the dome-shaped brush and the pulsator 3, and prevent the shoes from being stuck between the bottom portion of the dome-shaped brush and the pulsator 3 when the shoes are stirred by the pulsator 3 or the brush 5. Specifically, when the top portion of the pulsator 3 is provided with a plurality of water-stirring ribs 31 radially and the plurality of water-stirring ribs 31 intersect at the top center position of the pulsator 3. The horizontal surface of the bottom portion of the dome-shaped brush is arranged to abut against a top side of the water-stirring ribs 31 at the center position of the pulsator 3.

Figure 6:
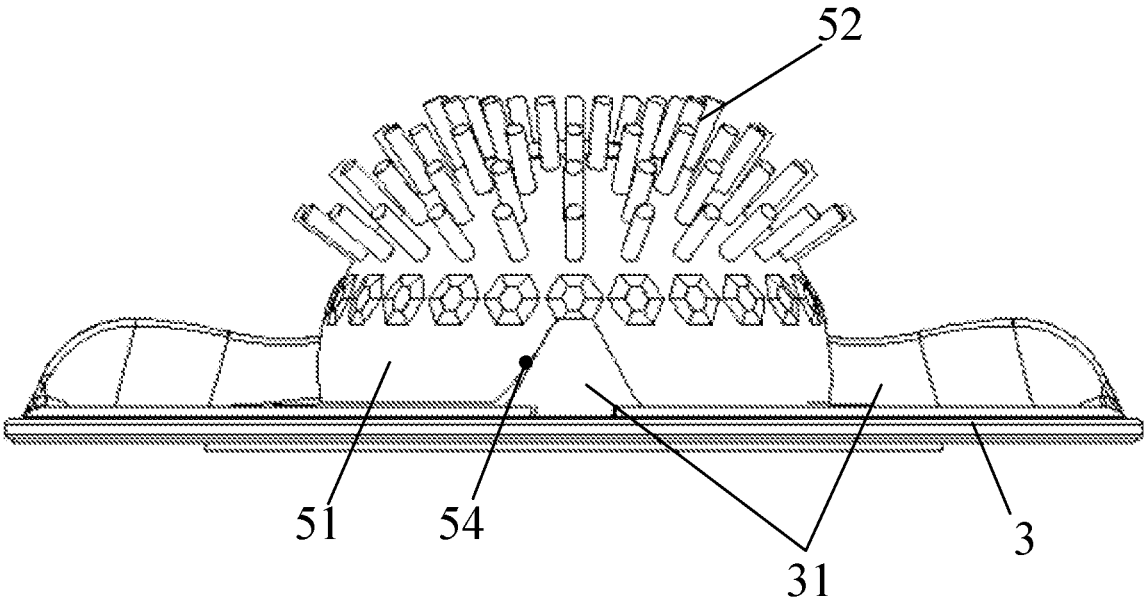
FIG. 6 is a front structural view of a bowl-shaped brush of the shoe washing machine of the present disclosure.
Figure 7:
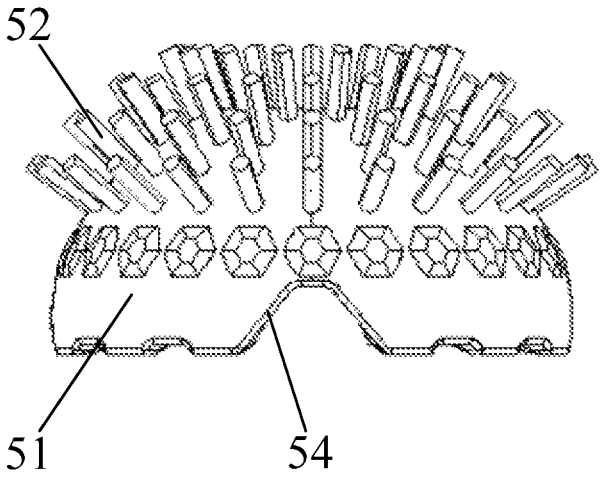
FIG. 7 is a schematic installation view of the bowl-shaped brush of the shoe washing machine of the present disclosure.

Reference is then made to FIGS. 6 and 7, in which FIG. 6 is a front structural view of a bowl-shaped brush of the shoe washing machine of the present disclosure, and FIG. 7 is a schematic installation view of the bowl-shaped brush of the shoe washing machine of the present disclosure. As shown in FIGS. 6 and 7, in another preferred embodiment, the brush 5 is a bowl-shaped brush; the top portion of the body 51 of the bowl-shaped brush is flat and nearly planar, and the side portion is formed by an arc-shaped curved surface protruding outward with a gradually increasing radial size. A bottom edge of the bowl-shaped brush directly abuts against the center of the top portion of the pulsator 3, and the intersection position of the plurality of water-stirring ribs 31 at the center of the top portion of the pulsator 3 is directly installed inside the bowl-shaped brush 5 by buckling. There is no gap between the brush 5 and the water-stirring ribs 31 of the pulsator 3 or the top surface, so as to eradicate the situation in which the shoes are stuck at the bottom portion of the brush 5.

In another preferred embodiment, the brush 5 is a spherical brush. A bottom portion of a lower hemisphere of the spherical brush is a curved surface converged at the center position of the bottom portion. The bottom portion of the spherical brush abuts against the center of the top portion of the pulsator 3 in an embedded manner, so that a width of the gap between the bottom position of the lower hemisphere of the spherical brush and the pulsator 3 is very small (almost nonexistent), and that the shoes basically will not be stuck between the bottom portion of the spherical brush and the pulsator 3.

Preferably, a middle portion height of the above spherical brush, bowl-shaped brush or dome-shaped brush or a brush with the radial size gradually increasing from the top portion to the bottom portion does not exceed 15 cm. The "middle portion height" specifically refers to a vertical distance between the highest position of the top portion of the bulging shape of the brush 5 and the top center position of the pulsator 3 (a distance by which the brush 5 protrudes into an interior of the body of the pulsator 3 during connection is not included in this height). The above arrangement can prevent the height of the center of gravity of the brush 5 from being too high, ensure the installation stability of the brush 5, enable the brush 5 not to shake when rubbing the shoes, and enable the brush 5 to have a high tolerance to shoe collision.

Preferred connection solutions between the brush 5 and the pulsator 3 will be described below with continued reference to the drawings, the bowl-shaped brush and the dome-shaped brush.

Preferably, the brush 5 is detachably connected with the pulsator 3, so that the brush 5 that has been installed and fixed can be detached when the brush 5 has problems such as wear of the bristles 52. Those skilled in the art can selectively provide an installation base at the bottom portion of the body 51 according to the specific shape of the body 51 of the brush 5 and the specific shape of the top portion of the pulsator 3.

Then, with continued reference to FIGS. 4 and 5, in a specific embodiment, a sleeve-like snap-fit seat 53 (i.e., the above installation base) is provided at the center of the bottom horizontal surface of the dome-shaped brush. The sleeve-like snap-fit seat 53 is vertically arranged with an opening thereof facing downward. A side wall of the sleeve-like snap-fit seat 53 is provided with a plurality of snap-fit grooves 54 in a circumferential direction, and the top portion of the pulsator 3 is provided with snap-fit protrusions matching with the snap-fit grooves 54, so that the dome-shaped brush 5 can be connected together through the snap-fit between the snap-fit grooves 54 and the protrusions. In an installed state, a bottom side of the sleeve-like snap-fit seat 53 closely abuts against the top surface at the center of the pulsator 3.

Further, the dome-shaped brush is installed on the pulsator 3 mainly by means of snap-fit. For example, the side wall of the sleeve-like snap-fit seat 53 between the snap-fit grooves 54 has a certain elastically deforming ability. Two side groove walls of the snap-fit groove 54 close to the opening of the groove are respectively provided with a convex structure in a direction of approaching each other, and the snap-fit protrusion is provided with accommodation grooves matching with the two convex structures. When installing the dome-shaped brush, the snap-fit groove 54 is snap-fit on the snap-fit protrusion, and the convex structures slide along the surface of the snap-fit protrusion, then enters the accommodation grooves and are snap-fit therein. When it is necessary to detach the dome-shaped brush, it is only required to slightly push the bottom of the side wall of the sleeve-like structure outward so that the convex structures can move out of the accommodation grooves, thus removing the dome-shaped brush.

Further, the dome-shaped brush is installed on the pulsator 3 also assisted by screwing. Specifically, in addition to the above sleeve-like snap-fit seat 53 and the snap-fit grooves 54, a threaded structure 55 is also provided at the bottom center of the dome-shaped brush 5, and a fastener through hole which is aligned with the threaded structure 55 is provided at the top center of the pulsator 3 in a penetrating manner. When installation of the dome-shaped brush is completed, the snap-fit grooves 54 are snap-fit on the snap-fit protrusions to limit the rotation of the dome-shaped brush, and a fastener such as screw and bolt passes through the fastener through hole from the bottom portion of the pulsator 3 and then is screwed to the threaded structure 55 to limit an axial movement of the dome-shaped brush. At this time, even if the groove walls of the snap-fit groove 54 are not provided with the above convex structures, the dome-shaped brush can still be fixed and limited axially through the fastener.

Specifically, the snap-fit protrusions are the water-stirring ribs 31 of the pulsator 3. The shape of the snap-fit groove 54 matches with a sectional shape of the water-stirring rib 31 of the pulsator 3 after vertical sectioning in the circumferential direction, and the number of the snap-fit grooves 54 is not smaller than the number of the water-stirring ribs 31, so that each snap-fit groove 54 can be snap-fit on one of the stirring ribs 31 respectively, and that there will be no need to additionally provide the snap-fit protrusion on the pulsator 3 for matching with the snap-fit groove 54. In addition, a snap-fit column matching with the sleeve-like snap-fit seat 53 by insertion is provided at a center intersection position of the water-stirring ribs 31 in a protruding manner, so as to further improve the installation reliability of the dome-shaped brush and increase an anti-collision performance of the dome-shaped brush. In case of completion of snap-fit, the sleeve-like snap-fit seat 53 is snap-fit on the snap-fit column, and the snap-fit grooves 54 are snap-fit on the water-stirring ribs 31 of the pulsator 3, so that the bottom of the body of the dome-shaped brush (i.e., the body 51) closely abuts against top surfaces of the water-stirring ribs 31 on the side close to the center of the pulsator 3.

Further, the sleeve-like snap-fit seat 53 is gradually expanded outward from top to bottom, and the radial size thereof is gradually increased. The snap-fit column at the top portion of the pulsator 3 is arranged as a frustum-shaped cylinder that matches with the sleeve-like snap-fit seat 53, so as to further increase a snap-fit contact area between the dome-shaped brush and the pulsator 3, and further improve a reliable installation effect of the dome-shaped brush.

Alternately, a vertical height of the sleeve-like snap-fit seat 53 arranged at the bottom portion of the dome-shaped brush is not larger than a height of the snap-fit column arranged at the top portion of the pulsator 3, so that when the sleeve-like snap-fit seat 53 is snap-fit on the snap-fit column, a bottom end of the sleeve-like snap-fit column is located above the water-stirring ribs 31. At this time, instead of providing the snap-fit grooves 54 on the sleeve-like snap-fit seat 53, a plurality of pins are arranged at the inside top portion of the sleeve-like snap-fit seat 53, and the top of the snap-fit column is provided with holes matching with the pins. A threaded hole is provided at the center of the plurality of pins and surrounded by the plurality of pins. After installation of the dome-shaped brush, the sleeve-like snap-fit seat 53 is snap-fit on the snap-fit column to limit a horizontal movement of the dome-shaped brush, the pins are inserted into the holes to limit the rotation of the dome-shaped brush, and the fastener limits the axial movement of the dome-shaped brush. The arrangement positions of the above pins and holes can also be interchanged.

Next, reference is made to FIGS. 6 and 7. In another preferred embodiment, in the case of the bowl-shaped brush 5, the bottom portion of the bowl-shaped brush is not provided with an installation base, and a certain accommodation space is provided on an inner side of the bottom of the body 51 of the bowl-shaped brush. The accommodation space can accommodate the intersection position of the water-stirring ribs 31, and the side of the body 51 is provided with a plurality of snap-fit grooves 54 in a circumferential direction at positions close to the bottom side. In an installed state, the snap-fit grooves 54 are embedded on the water-stirring ribs 31, so that the protruding position formed after the intersection of the water-stirring ribs 31 at the top center of the pulsator 3 can be installed by the body 51 by buckling, and that a bottom edge of the body 51 can seamlessly abut against the top surface at the center of the pulsator 3 and the protruding surfaces of the water-stirring ribs 31. On this basis, the bowl-shaped brush can also be assisted by the same connecting way as screwing the above dome-shaped brush to the pulsator 3 to increase the installation reliability. In view that the specific screwing way has already been described in the above embodiment, a repeated description will be omitted herein.

It can be understood by those skilled in the art that the connection between the above brush 5 and the pulsator 3 is not limited to the above detachable connection. When there is no need for the brush 5 to be detachable, the brush 5 can also be directly integrated with the pulsator 3. Moreover, the detachable connection between the brush 5 and the pulsator 3 is not limited to that described in the above example. For example, the brush 5 can also be connected to the pulsator 3 by means of claw clamping. Those skilled in the art can improve or replace the above structure combination of the snap-fit grooves 54 and the snap-fit protrusions and the fixing means of screwing in terms of structural form or connection means, as long as the reliable connection between the brush 5 and the pulsator 3 and convenient disassembly and assembly can be realized.

To sum up, the shoe washing machine of the present disclosure is provided with the brush 5 having an upward bulging shape at the center of the top portion of the pulsator 3, so as to optimize the smoothness of the streamline of the brushing surface of the brush 5, soften the brushing effect of the brush 5, enable the brush 5 to have the function of non-destructive shoe brushing, and also reduce the probability that the brush is stuck with the shoes, thus resulting in an elaborate structure and strong practicability.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A shoe washing machine, comprising:

a washing tub, a pulsator rotatably arranged at an inner bottom portion of the washing tub, and a brush arranged at a center of a top portion of the pulsator, wherein the brush is arranged in a shape that bulges upward from the top portion of the pulsator and is detachably connected with the pulsator, wherein a bottom portion of the brush is provided with a snap-fit seat, and the snap-fit seat has a side wall provided with a plurality of snap-fit grooves in a circumferential direction;

wherein the side wall includes a side wall segment formed between every pair of adjacent snap-fit grooves in the circumferential direction, and the side wall segments have an elastically deforming ability, wherein the side wall segments located at two opposite sides of each of the snap-fit grooves and close to an opening of the snap-fit groove are respectively provided with a convex structure in a direction of approaching each other; and wherein the top portion of the pulsator is provided with snap-fit protrusions matching with the snap-fit grooves, and the snap-fit protrusion is provided with accommodation grooves matching with the convex structures so that the brush is able to be detached from the pulsator by slightly pushing a bottom of the side wall segment outward to move the convex structures from the accommodation grooves.

2. The shoe washing machine according to claim 1, wherein the brush is arranged to have a radial size that gradually increases or stepwise increases from a top portion to a bottom portion.

3. The shoe washing machine according to claim 2, wherein the brush is a bowl-shaped brush, a conical brush, a spherical brush or a dome-shaped brush.

4. The shoe washing machine according to claim 1, wherein the brush comprises a lower section and an upper section; the lower section is arranged in a columnar shape, and the upper section is arranged in a shape that bulges upward from a top portion of the lower section.

5. The shoe washing machine according to claim 4, wherein the upper section is bowl-shaped, conical, spherical or dome-shaped.

6. The shoe washing machine according to claim 1, wherein a bottom portion of the brush is arranged to abut against the top portion of the pulsator.

7. The shoe washing machine according to claim 1, wherein the snap-fit protrusions are water-stirring ribs of the pulsator, and a snap-fit column matching with the snap-fit seat by insertion is provided at a center intersection position of the water-stirring ribs.

8. The shoe washing machine according to claim 7, wherein the snap-fit seat is gradually expanded outward from top to bottom.

9. The shoe washing machine according to claim 1, wherein the bottom portion of the brush is provided with a threaded structure, and the pulsator is further provided with a fastener through hole aligned with the threaded structure.

10. The shoe washing machine according to claim 2, wherein the brush has a body that is a three-quarters sphere.

* * * * *